US005605407A

United States Patent [19]

Hama et al.

[11] Patent Number: 5,605,407

[45] Date of Patent: Feb. 25, 1997

[54] PRINTER AND ITS CONTROL METHOD

[75] Inventors: Susumu Hama; Hiroshi Takizawa; Toshiaki Watanabe; Masahiro Kamijo; Manabu Shimizu, all of Suwa, Japan

[73] Assignee: Seiko Epson Corporation, Tokyo, Japan

[21] Appl. No.: 362,684

[22] Filed: Dec. 22, 1994

[30] Foreign Application Priority Data

Dec. 27, 1993 [JP] Japan ..... 5-333329

[51] Int. Cl.[6] ..... B41J 29/42

[52] U.S. Cl. ..... 400/705.1; 400/279; 400/322

[58] Field of Search ..... 400/279, 705, 400/705.1, 705.3, 706, 705.2, 705.4, 705.5, 322

[56] References Cited

U.S. PATENT DOCUMENTS

| | | | |
|---|---|---|---|
| 3,891,077 | 6/1975 | Sauerbrunn | 400/124.04 |
| 4,264,220 | 4/1981 | Okcuoglu | 400/144.2 |
| 4,869,609 | 9/1989 | Iwata | 400/323 |
| 5,090,829 | 2/1992 | Lee et al. | 400/705.1 |
| 5,368,402 | 11/1994 | Takahashi et al. | 400/279 |
| 5,433,541 | 7/1995 | Hieda et al. | 400/279 |

FOREIGN PATENT DOCUMENTS

| | | |
|---|---|---|
| 0291099 | 11/1988 | European Pat. Off. . |
| 90761 | 4/1989 | Japan . |
| 008383 | 1/1993 | Japan . |

*Primary Examiner*—Christopher A. Bennett
*Attorney, Agent, or Firm*—Eric B. Janofsky

[57] ABSTRACT

A printer is provided comprising a carriage on which recording head is mounted. Drive mechanisms for moving carriage in reciprocating motions an encoder having openings provided contiguously in the circumferential direction at fixed intervals, attached thereto, and which rotates as carriage moves. A position detector is provided in proximity to the encoder for detecting the encoder's detection-target unit and generates timing pulses in response thereto. A shielding plate is attached to carriage for blocking the encoder from the position detector at the home position. A processor detects the home position for carriage based upon a timing pulse pause time.

6 Claims, 8 Drawing Sheets

200

PRINTER AND ITS CONTROL METHOD

BACKGROUND OF THE INVENTION

1. Field of Invention

This invention relates generally to a serial printer that reciprocally moves a recording head in a direction perpendicular to the direction of movement of a recording paper in order to print thereon. In particular, the present invention relates to the detection of a home or reference position of the recording head.

2. Description of the Related Art

An example of a serial printer is one that is discussed in JP-A-90671/1989. This serial printer comprises a recording head unit, a carriage on which the recording head is mounted; a motor that drives the carriage, a dot pulse generator composed of a disc, containing a slit attached to the motor axis located at the lower part of the motor as well as a photo interrupter, and a home position detector composed of a second photo interrupter that detects the shielding plate attached to the lower part of the carriage. The above-mentioned serial printer when detecting its print position, detects the motor's rotational angle by means of a dot pulse generator and detects the relative print position (dot-to-dot distance) of the recording head during the printing operation. The device detects the home position (or reference start-of-print position), which is the recording head's absolute print position, with of a home position detector. The serial printer disclosed in JP-A-90671/1989 is equipped with position detectors for detecting those positions, and therefore requires two or more detectors. These two or more detectors are additional cost to the printer and require a more complicated circuitry to process these detectors.

OBJECTS OF THE INVENTION

It is an object of the present invention to overcome the aforementioned problems with conventional serial printers.

It is another object of the present invention to provide a serial printer capable of accurately detecting, by means of a single detector, the home position of the carriage on which the recording head is mounted and the position of the carriage during a printing operation.

SUMMARY OF THE INVENTION

According to this invention, a printer is provided with a carriage on which a recording head is mounted. A drive mechanism reciprocally moves the carriage, and an encoder whose target-of-detection units are provided contiguously at fixed intervals in the circumferential direction and which is attached to the drive mechanism, rotates as the carriage moves. A position detection means, provided in proximity to the encoder, detects the encoder's target-of-detection units and generates timing pulses. A shielding plate, attached to the carriage, interrupts the encoder from the position detection means at the home position, and a processing means reads the timing pulses from the position detection means and detects the carriage's home position based upon the timing pulses' pause time.

The printer control method of the present invention for initialization has the following procedure. First of all, the processing means starts up the drive mechanism when the power is turned on, and the processing means measures timing pulses width that are output from the position detection means while moving the carriage in the direction of the home position. When the pulse width reaches a value greater than or equal to a predefined reference time, the processing means begins to count the number of the timing pulses. When the number of said pulses reaches a predefined reference value, the processing means stops the drive mechanism, thereby initialization of the printer is completed.

The printer control method of the present invention for printing operation has the following procedure.

The processing means drives the drive mechanism and counts the timing pulses that are output from the position detection means, thereby the carriage moves to a print area from the home or reference position. Second, the processing means operates one line printing according to recording data after when the carriage reaches the print area.

If no recording data remains in memory means, the processing means terminates the drive mechanism when the timing pulse count reaches a predefined reference count, thereby the printing operation is completed.

On the other hand, if another recording data remains, then the processing means begins to measure the timing pulses width when the timing pulse count reaches a predefined reference count. When the pulse width becomes greater than or equal to a predefined reference time, the pulse count is reset and the processing means begins to count the timing pulses again. And then the processing means continues to operate one line printing again according to recording data after when the carriage reaches the print area.

In the present invention, the carriage is moved in shuttling or reciprocating motions by the drive mechanism. During this operation the encoder attached to the drive mechanism also rotates. The position detection means is provided in proximity to the encoder. If, for example, the position detection means is designed to detect positions by means of a photo transceiver, the light is transmitted when the encoder rotates and a small hole, which is a detection-target unit, comes up, and the light is blocked when any other positions come up. In this manner, timing pulses are generated proportionally to the rotation of the encoder. When the carriage reaches the home position, the shielding plate blocks the position detection means from the encoder. This results in an interruption of the timing pulses or extended pause time between the adjacent timing pulses, which are output from the position detection means. In particular, the attendant increase in the timing pulses' pause time enables the processing means to use the increase pause time as the reference value by which to detect the carriage's home position.

The printer control method of this invention measures the pulse width of the timing pulses output from the encoder by moving the carriage as the power is turned on. When the carriage reaches the home position, the shielding plate blocks the position detection means from the encoder, in which case timing pulses proportional to the rotation of the encoder can no longer be detected. When detecting that the time between adjacent pulses is greater than or equal to a predefined reference time (an abnormally long time for a timing pulse that is supposed to be proportional to the encoder rotation), the processing means determines that the carriage is at the home position. However, if the drive mechanism for the carriage is stopped as soon as this determination is made, the carriage's inertial force causes the carriage to overshoot the home position and prevents it from stopping at the required position. To circumvent this problem, the carriage is forced to make another back-and-forth motion so that when the carriage moves past the home position, the counting of timing pulses is started, and by stopping the drive mechanism when the pulse count reaches a reference value that corresponds to the home position minus the distance that the carriage travels due to inertia, thus the carriage can be stopped accurately at the home position.

Further, if the carriage, located at the home position, must be moved and then returned to the home position after the carriage has performed printing, this method begins to count timing pulses based upon the home position as the reference point, performs one line of printing based upon the timing pulses at a prescribed print position. If, after the printing operation is completed, the pulse count reaches the reference value that provides for the distance over which the carriage moves due to inertia, the drive mechanism is stopped. In this manner, the carriage can again be stopped accurately at the home position.

If the printing is to be continued without stopping the carriage after one line of printing is completed, the processing means measures the timing pulse width when the timing pulse count reaches the aforementioned reference value. In this manner, the processing means can recognize the home position, begin counting timing pulses based upon the home position, and perform another printing based on the timing pulses. In this manner any misalignment of the start-of-print position in a given line can be precluded.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings, wherein like reference numerals refer to like parts

FIG. 7 is a flowchart of an initialization operation for positioning the carriage at the home position when the power is turned on;

DESCRIPTION OF THE PREFERRED EMBODIMENTS

Figure 1:
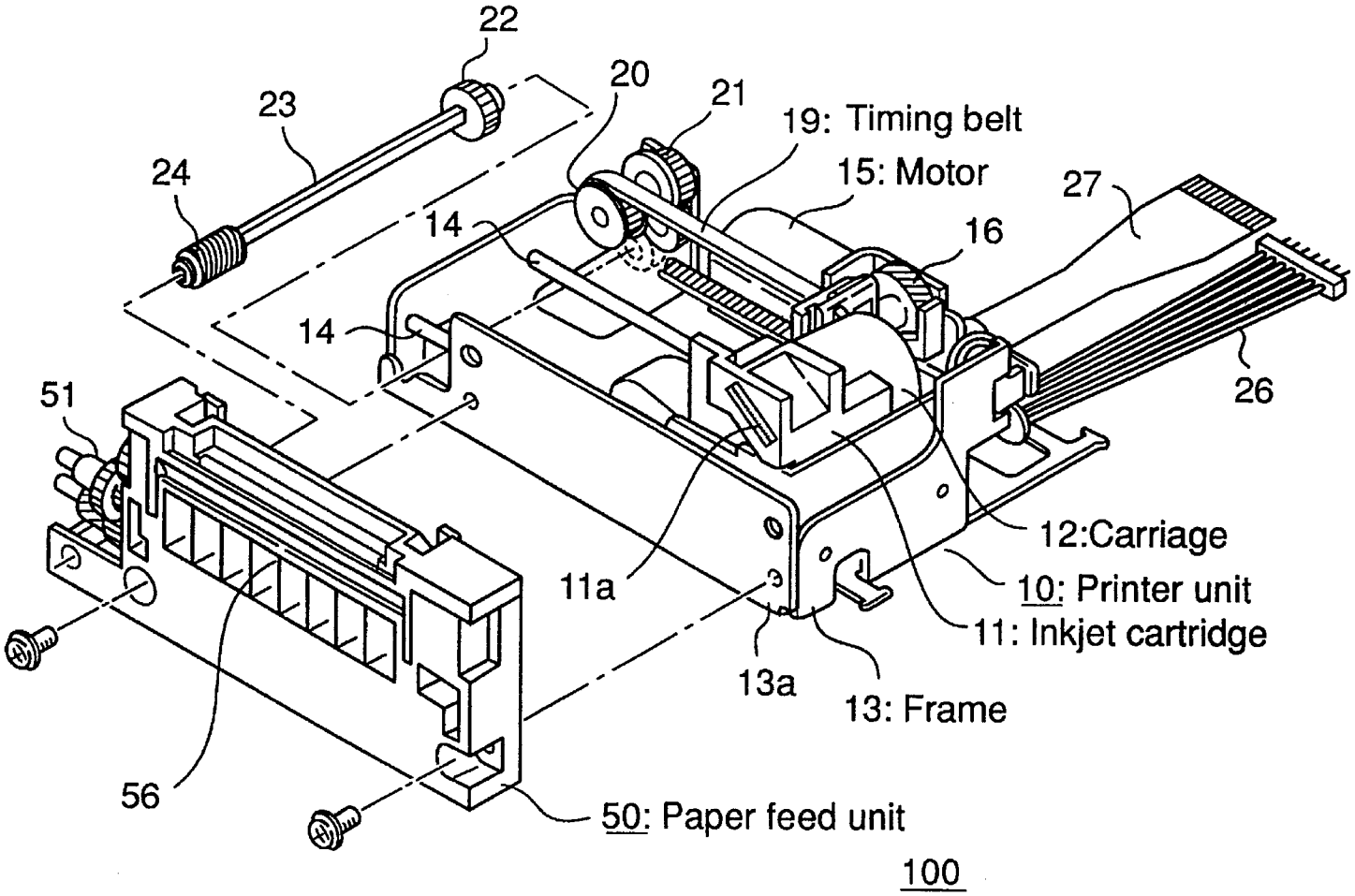
FIG. 1 is a perspective-view diagram of an inkjet printer according to an embodiment of the present invention.
Figure 2:
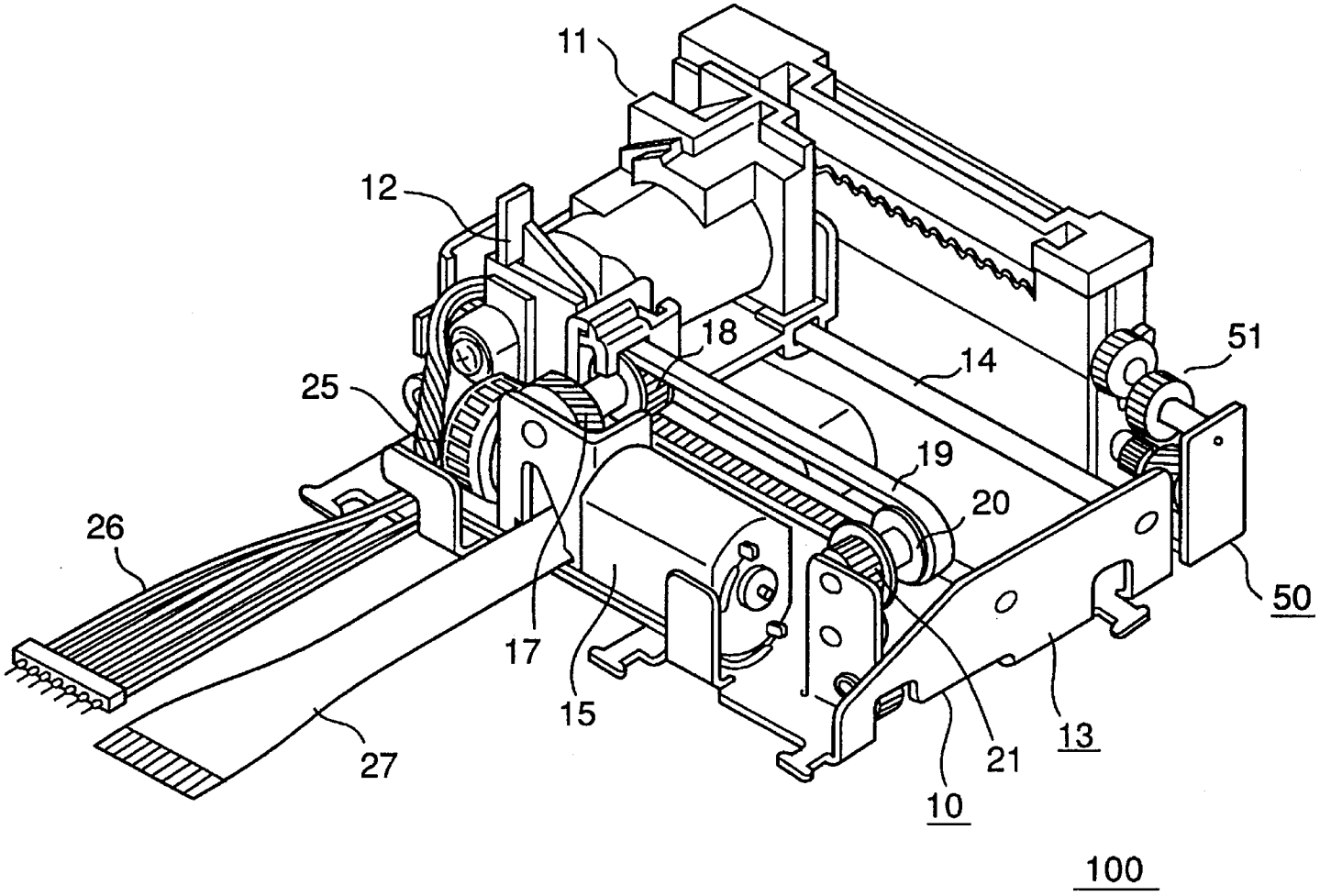
FIG. 2 is a perspective-view diagram of the inkjet printer of FIG. 1, as viewed from the motor side.

Reference is now made to the accompanying figures. FIG. 1 is an exploded view of an inkjet printer 100 in accordance with an embodiment of the present invention, and FIG. 2 is a perspective-view of inkjet printer 100 of FIG. 1 viewed from the motor side. As shown in these figures, the inkjet printer is composed of printer unit 10 and paper feed unit 50. Printer unit 10 includes an inkjet cartridge 11 on which recording head 11*a* and an ink reservoir (not shown) are mounted. Inkjet cartridge 11 is removably mounted to cartridge 12. Carriage 12 is supported by a pair of guide rods 14, which are provided on frame 13, so that the carriage can reciprocally move in its axial direction. Motor 15, that supplies the drive source for driving carriage 12, implemented as a DC motor, for example. Motor 15 is rotated and driven in a single direction, and the rotational energy of motor 15 is transmitted to gear 16. Gear 16 is arranged to mess with an engaged gear 17, and causes engaged gear 17 and drive wheel 18 to rotate and drive timing belt 19. This rotation causes subordinate drive wheel 20 to spin, and rotates gear 21, which is connected to drive wheel 20. Timing belt 19 is provided with a drive pin 30 (shown in FIG. 3) that reciprocally moves carriage 12.

Gear 22 engages with gear 21, which is coaxially arranged on the side of subordinate drive wheel 20. Gear 22 is provided at one end of transmission axis 23. The other end of this axis is provided with gear 24. The rotation of gear 22 supplies a drive source to paper feed unit 50 through transmission axis 23 and gear 24.

Printer unit 10 is provided with encoder 25 that detects the rotation of motor 15. The encoder is connected to the rotational axis of motor 15 through a gear (not shown). Further, as shown in the figures, control line 26 is provided for electrically connecting a controller (not shown) to motor 15 and sensors 31 (shown in FIG. 4). A control line 27 electrically connects the controller to recording head 11*a*.

Paper feed unit 50 is provided with gear train 51 that engage with gear 24 that is provided on the other end of transmission axis 23 of printer unit 10. Gear train 51 are linked to a pair of paper feed rollers 52 and 53 (shown in FIG. 3).

Further, gear train 51 contain intermittent gears. When inkjet cartridge 11 moves in one direction, performs printing, and them moves in the opposite direction to return to its home position, the intermittent gears rotate paper feed rollers 52 and 53 by one line, and advance the recording paper inserted from insertion slit 56 by one line. Paper feed unit 50 is fixedly secured preferable by a pair of screws onto guide surface 13*a*. Guide surface 13 is constructed by bending frame 13 of printer unit 10 upward by the right angle, and is thus secured onto printer unit 10.

Figure 3:
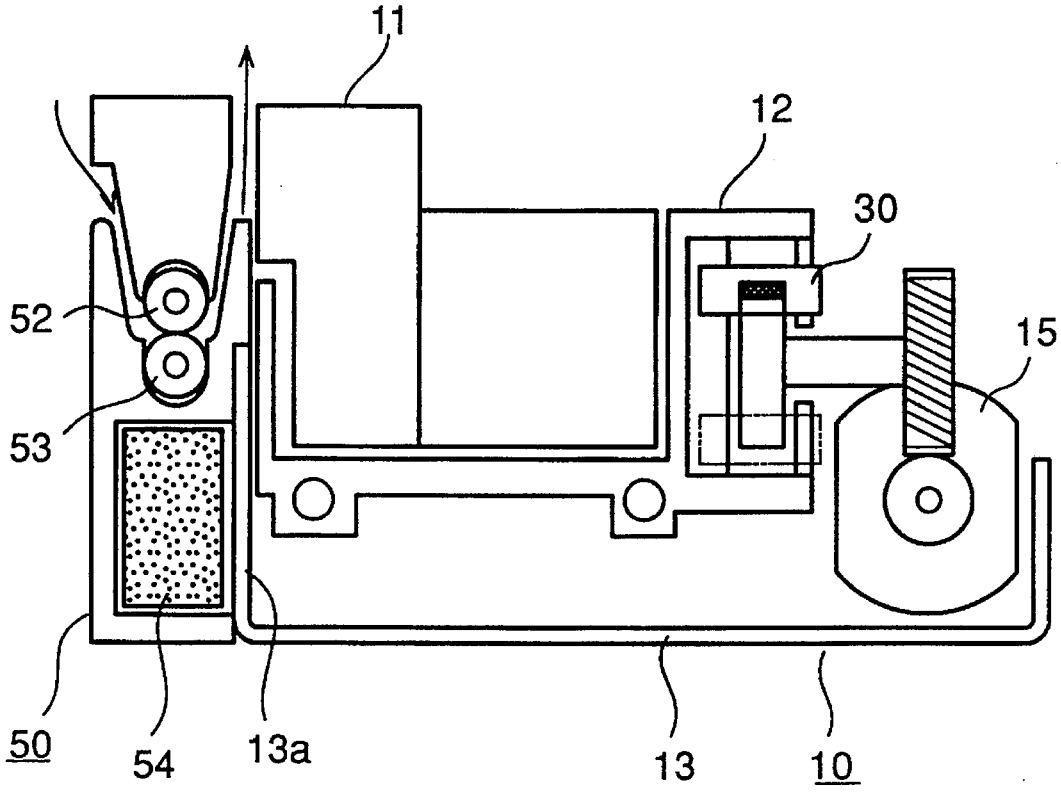
FIG. 3 is a cross-sectional view depicting carriage drive and paper feed mechanisms for the inkjet printer of FIG. 1.

FIG. 3 illustrates the drive and paper-feed mechanisms for the carriage. Although motor 15 rotates only in one direction, carriage 12 must be able to move in reciprocal or shuttling motions. Therefore, drive pin 30 is attached to timing belt 19, as shown in the figure, so that drive pin 30 moves carriage 12 by engaging with the latter. When drive pin 30 is at the position (top) indicated by the solid line, carriage 12 is moved from the right to the left, for example; conversely, when drive pin 30 is at the position indicated by the two-dot chain line (bottom), carriage 12 is moved from left to right. Since this mechanism is known to those skilled in the art, its detailed explanation is omitted.

As noted above, paper feed unit 50 is provided with a pair of paper rollers 52 and 53, which are linked to gear train 51. The paper feed rollers 52 and 53 rotate mutually in opposite directions when recording head 11*a* of inkjet cartridge 11 returns to its reference or home position after printing one line, thus causing the recording paper to advance one line in the direction indicated by the arrow. The lower part of the paper feed unit 50 is provided with ink absorber 54 that absorbs the ink which is output from the supplementary outlet on recording head 11*a*. Ink absorber 54 is removable secured to paper feed unit 50, for easy replacement by removing paper feed unit 50 from printer unit 10.

Figure 4:
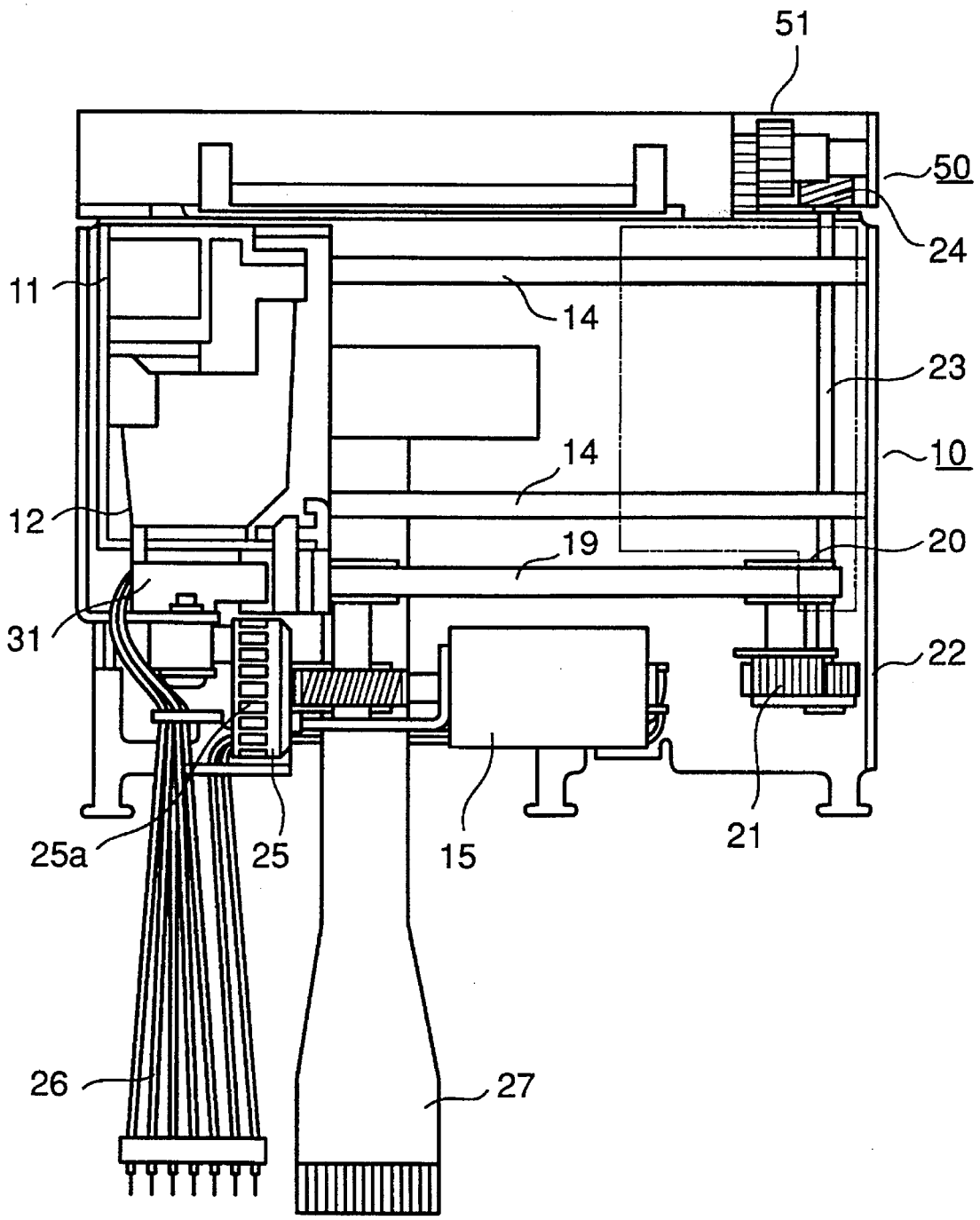
FIG. 4 is a top plan view of the inkjet printer of FIG. 1.

FIG. 4 is a top plan view of the inkjet printer of FIG. 1. As shown therein, encoder 25 is inserted into the opening of a C-shaped sensor 31. As will be understood, as encoder 25 rotates, openings 25*a*, which are provided along the circumference of the encoder, allow the passage of the light emitted from one end of sensor 31 so that the other end of sensor 31 can receive the light. In this way sensor 31 generates a timing pulse and detects the rotation of motor 15, i.e., the position of carriage 12.

In the inkjet printer composed as described above, control signals for motor 15 and sensor 31 are supplied through control line 26. Likewise, control signals are supplied through control line 27 to recording head 11*a*, which is mounted on inkjet cartridge 11. As noted above, the rotational drive of motor 15 drives timing belt 19. As the timing belt spins, drive pin 30 moves, and drive pin 30 causes carriage 12 to move along guide axis 14. During these motions ink is output from recording head 11*a* according to the control signals and printing is performed. When one-line-worth of printing is completed, the paper-feed drive power is transmitted to paper feed unit 50 through transmission axis 22, and the rotations of paper-feed rollers 52 and 53 cause the recording paper to advance by one line. The above operations are performed repeatedly for each line that is printed.

In the embodiment shown in FIG. 1, the provision of a drive mechanism in the back of inkjet cartridge 11 enables the printer to perform slip printing. Slip printing can be performed by removing paper feed unit 50 of FIG. 1 from printer unit 10 and by allowing head 11 to move closer to the recording paper. In this case the guiding of slip printing is accomplished by guide surface 13*a*.

Although the above embodiment shows the case where paper feed unit 50 is secured onto inkjet printer unit 10 with screws, the present invention is by no means limited to this method of securing. Other means, such as permanent magnets, can be employed as long as the means allows easy detachment of the paper feed unit.

Figure 5:
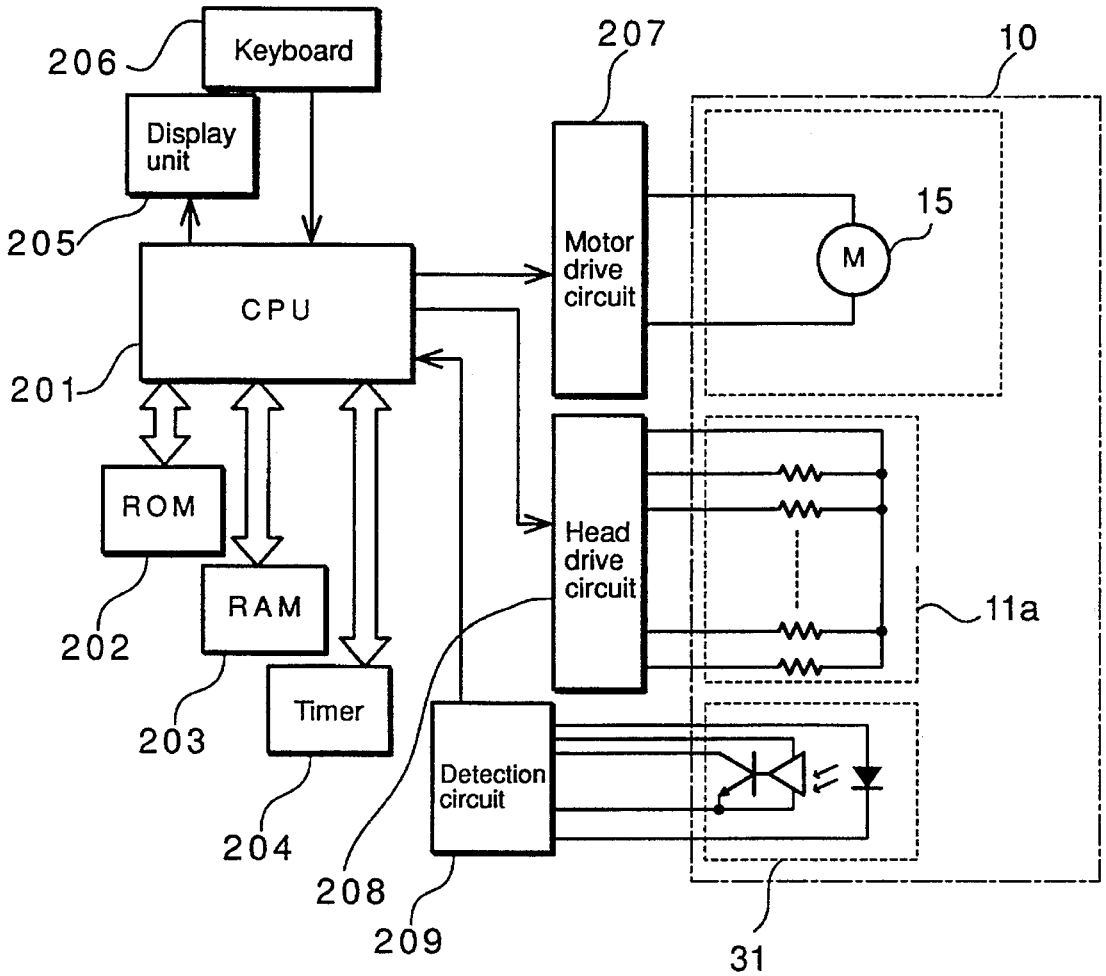
FIG. 5 is a schematic diagram of a desktop electronic calculator that incorporates the inkjet printer and the drive control device of FIG. 1.

FIG. 5 is a block diagram showing a printer incorporating the above mechanisms and the circuit configuration of a desktop electronic calculator 200 (hereinafter "DEC") equipped with a drive control device that controls the printer. The DEC is provided with a processor or CPU 201, which controls the entire operation DEC 200 in accordance with preprogrammed instructions stored in memory ROM 202; RAM 203; timer 204; display unit 205; and keyboard 206. CPU 201 is connected to the components of printer unit 10 through its I/O port and control line 26. Head drive circuit 208 is connected to recording head 11*a* and control line 27. Motor drive circuit 207 is connected to motor 15 and sensor 31, which outputs the timing signals and detects the position of recording head 11, is connected to CPU 201 through detection circuit 209. The operation of these components is readily apparent to those skilled in the art.

Figure 6A:
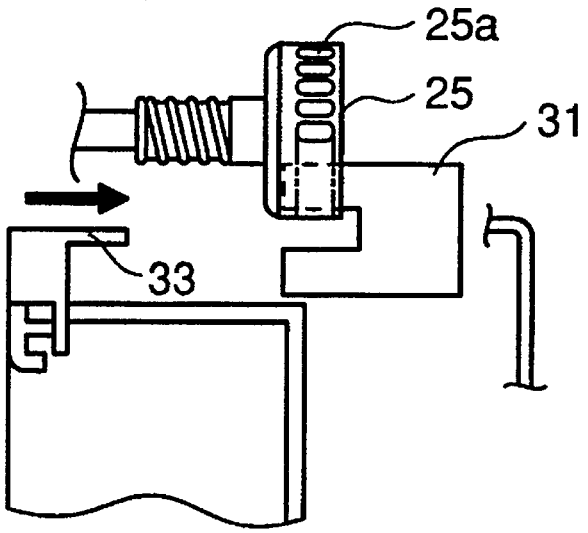
FIGS. 6A–6C illustrate the mechanism for detecting a carriage home position in the printer of FIGS. 1 and 5.
Figure 6B:
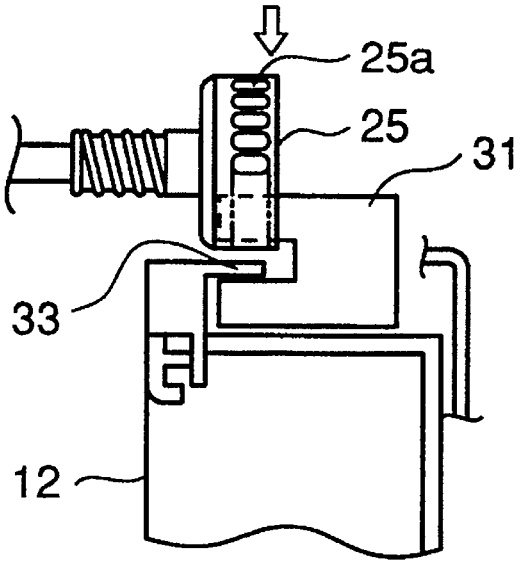
Figure 6C:
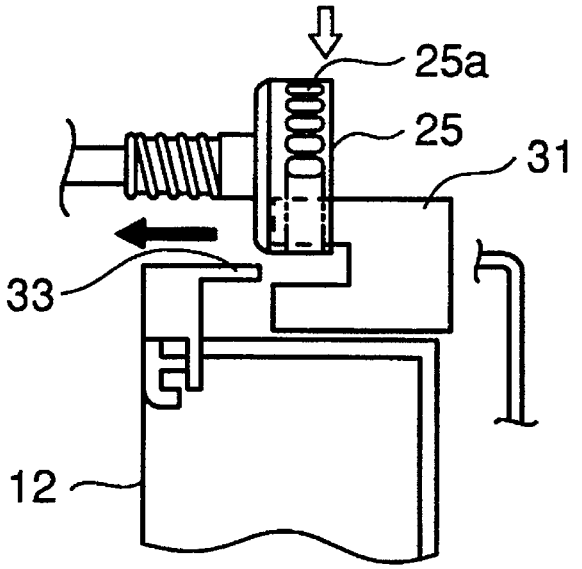

FIGS. 6A–6C depicts a mechanism that detects the home or reference position of carriage 12 on the inkjet printer of FIG. 1. FIG. 6A illustrates carriage 12 and shielding plate 33 moving in the direction of the arrow towards sensor 33. In this state, shielding plate 33 is not blocking the light in sensor 31, and sensor 31 detects the rotation of motor 15, as noted above. In FIG. 6B, carriage 12 is substantially in the home position and shielding plate 33 blocks the emitted light from sensor 31. As such sensor 31 no longer can detect the timing pulse or the rotation of motor 15. Referring to FIG. 6C, carriage 12 is moving away from the home position such that sensor 31 receives light via its opening 25*a* in conjunction with the rotation of rotary encoder 25 and generates timing pulses when carriage 12 moves out of the home position.

When carriage 12 reaches the home position, shielding plate 33 is position to block the light path for sensor 31. In this arrangement, the length of time during which the light path is blocked or interrupted by shielding plate 33 is greater than the length of time in which light is allowed to pass by opening 25*a* of rotary encoder 25. Thus, it is possible to detect shielding plate 33 in the sensor 31 by measuring the elapsed time to determine that carriage 12 has reached the home or reference position.

Figure 7:
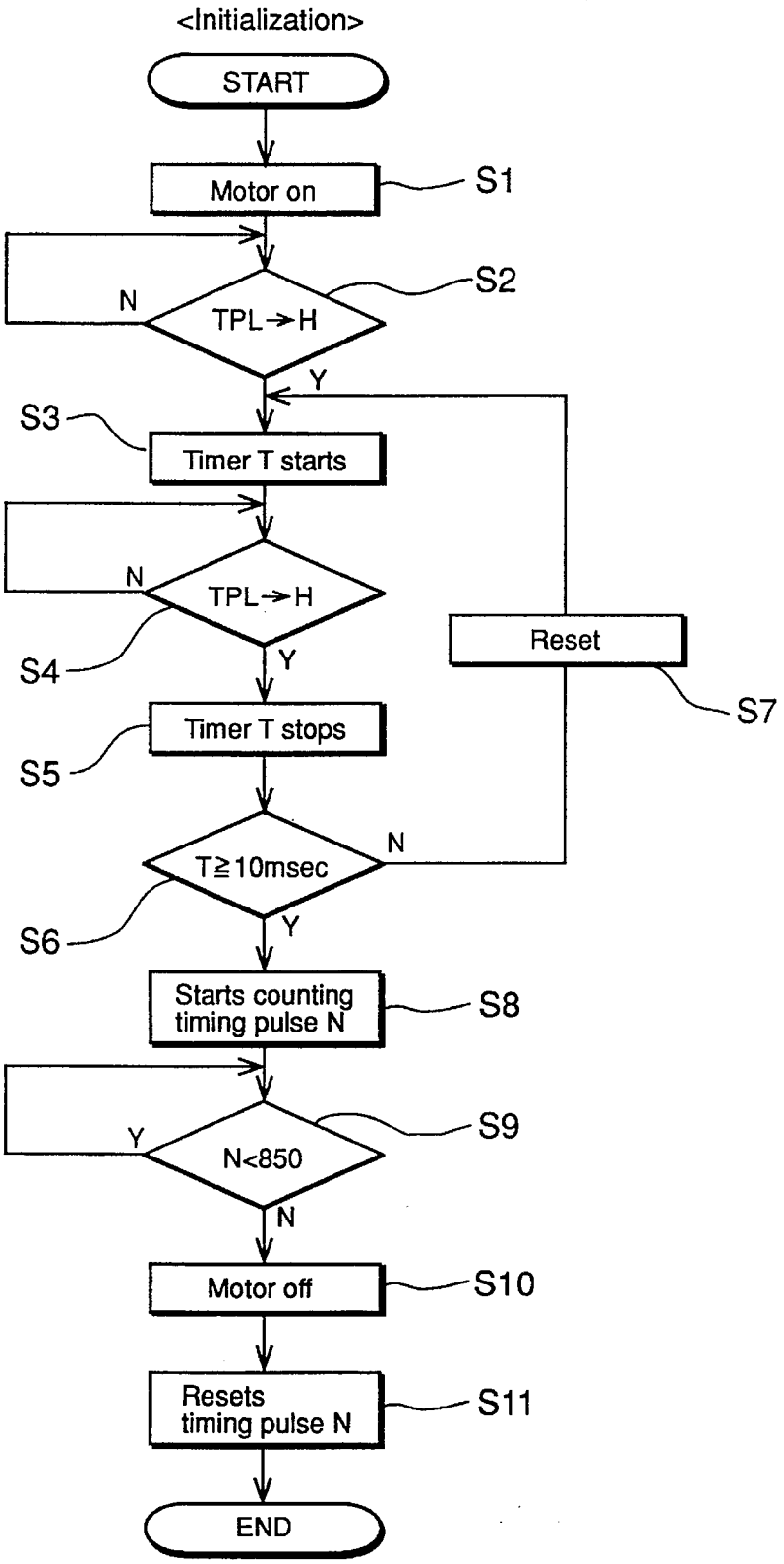

FIG. 7 is a flowchart depicting the initialization operation that positions the carriage, on which a recording head is mounted, at the home position when the power is turned on. First, the power for motor 15 is turned on in order to start the motor (S1). CPU 201 reads a detection signal from sensor 31, i.e., a timing pulse, through detection circuit 209 and waits until the timing pulse (TP) changes from L (low-level signal) to H (high-level signal) (S2). When the timing pulse has changed from L to H, the CPU 201 starts the measurement by timer 204 (S3). After that, CPU 201 waits again until the timing pulse changes low to high (S4). When the timing pulse has become high, CPU 201 stops the measurement by timer 204 (S5). Thus, a pulse width of the timing pulse is obtained by executing steps (S2) to (S5). Then, CPU 201 determines whether or not the time between adjacent pulses measured by timer 204 is greater than or equal to 10 msec (S6). If the measured value is not greater than or equal to 10 msec, the CPU assumes that normal timing pulses are being measured, resets timer 204 (S7), and returns to the above step (S3).

Figure 8A:
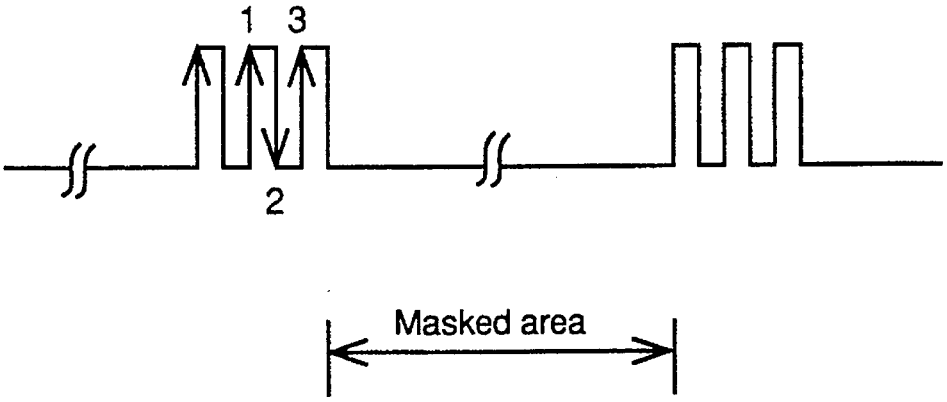
FIGS. 8A–8C are timing charts for timing pulses of the embodiment in FIG. 5.
Figure 8B:
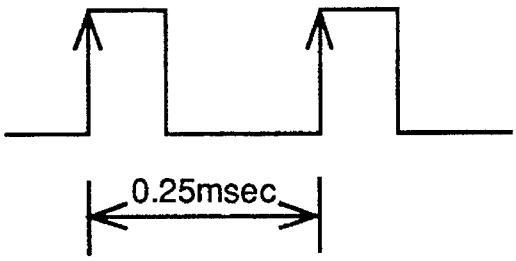
Figure 8C:
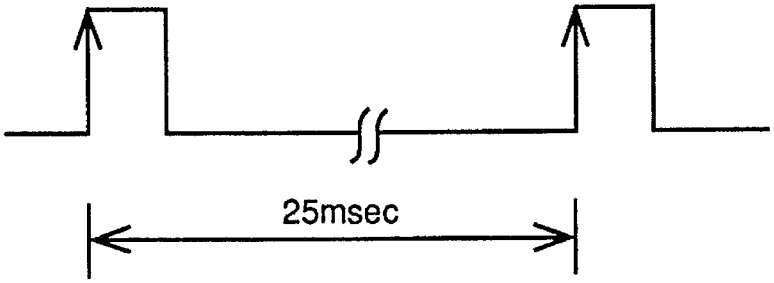

FIGS. 8A–8C are timing charts for the timing pulses. In this embodiment the timing pulse cycle is assumed to be 0.25 msec, for example, and the area masked by shielding plate 33 or interruption between adjacent timing pulses is assumed to be 25 msec, for example. In step (S5), because the measurement time in which timer 204 is stopped for the normal area (a non-masked area) is 0.25 msec, control returns to the processing at step (S3). On the other hand, in the masked area the measurement time in which timer 204 is stopped at step (S5) is 25 msec, which results in a timer 204 measurement value greater than or equal to 10 msec. When the end of the masked area is detected in this manner, the CPU begins to count timing pulses (S8). If the end of the masked area is on the left side of the printer, for example, carriage 12 advances toward the right and reaches the right edge, from which it advances again toward the left. When the carriage approaches the left edge and the count reaches a value such as "850" (assuming that there are "916" timing pulses per round-trip of the carriage) (S9), the drive power for motor 15 is turned off at that timing (S10).

This causes motor 15 to stop after rotating for a fixed time (e.g., for "66" pulses) by inertia at a position coincident with the home position. Specifically, in step (S6) when the time measured by timer 204 is greater than or equal to 10 msec, carriage 12 should stop at the home position in that timing. However, if motor 15 is stopped at that time, the carriage cannot be made to stop at the home position. Therefore, using this timing as a starting point, carriage 12 is allowed to make one round trip, and the drive power for motor 15 is turned off at a predetermined time equal to the distance over which the carriage moves due to inertia prior to the time when the carriage reaches the home position. In this way, carriage 12 is made to stop at the home position. After the drive power for motor 15 is turned off, the timing pulse count value is reset (S11).

The printing operation is explained as follows. First, when carriage 12 is at the initial state as indicated above, namely, when it is stopped at its home position, the carriage is started in its motion by turning on the drive power for motor 15, and CPU 201 then begins the count timing pulses. During this operation motor 15 is accelerated, and when the pulse count reaches a prescribed value, approximately 40, the motor shifts from the acceleration mode to the constant-speed mode in order to perform printing. In this operation the printing is performed as carriage 12 moves from the left edge to the right edge. If, for example, a line is 19 columns, a character is 9 dots, 1 dot corresponds to 2 pulses, 19 columns×9 dots/character×2=342. Thus, the number of pulses that are generated per line of printing is 40+342=382 pulses. Upon reaching the right edge, carriage 12 automatically begins to move to the left, at which time paper feed unit 50 advances the recording paper by one line. When the number of timing pulses reaches "850", the CPU determines whether or not the printing is to be continued (i.e. whether or not recording data remains in RAM 203. If the printing operation has been completed, the CPU turns off the drive power for motor 15. This causes motor 15 to rotate for a fixed length of time by inertia, and to stop at the home position as in the case of the initialization described above.

If the printing operation is to be continued, CPU 201 waits until the timing pulse from sensor 31 changes from low to high, as in the case of the initialization described above. When the timing pulse has changed from low to high, CPU 201 starts the measurement by timer 204. After that, CPU 201 waits until the timing pulse changes from low to high.

When the timing pulse has become high, CPU 201 stops the measurement by timer 204. Then, CPU 201 determines whether or not the value measured by timer 204 is greater than or equal to 10 msec. If the measured value is not greater than or equal to 10 msec, CPU 201 assumes that normal timing pulses are being measured, resets timer 204, and returns to the above step (S29). When the value measured by timer 204 becomes greater than or equal to 10 msec, the current position is at the end of the masked area, i.e., the home position. In this case, the CPU 201 resets the timing pulse count, returns to the above step, and prints another line. The above operations are repeated until the printing is completed.

Although this embodiment is described in terms of an inkjet head as a recording head, the present invention is by no means limited to the use of inkjet heads; it can be applied to serial printers using a wire dot head or a thermal head, or a character head.

As described above, in the printer of the present invention the rotation of the encoder, attached to the drive mechanism that moves the carriage in shuttling motions, is detected by the position detection means in order to generate timing pulses. At the home position a shielding plate blocks the position detection means from the encoder, thus generating pause-time timing pulses that are different from steady-time timing pulses and that are identified by a processing means in order to determine the carriage's home position. The result is that only one position detector is required, thus simplifying the printer mechanism.

Further, according to the printer control method of the present invention, the processing means controls the carriage based on measuring the pulse width or counting number of timing pulses so that, the carriage is made to make one more round trip after the determination is made that the carriage is at the home position, and that the drive mechanism is stopped before the home position at a distance equal to the distance over which the carriage moves by inertia when it comes to a halt. In this way any overshooting of the home position by the carriage due to inertia is eliminated, and the carriage can be stopped accurately at the desired position.

Further, if multiple lines are to be printed continuously without stopping the carriage at the home position, the processing means can measure the pulse width of the timing pulses for each line before the carriage reaches the home position, can determine that the carriage is at the home position, and can begin counting timing pulses relative to the home position. By performing printing based upon timing pulses in this manner, the printer can ensure that the start-of-print position is determined accurately for each position without any misalignment.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printer control method for a printer comprising the steps of:

(a) applying power to a drive mechanism;

(b) driving the drive mechanism as power is applied in step (a) for moving a carriage in a direction to a reference position;

(c) measuring a pulse width of timing pulses from a position detection means while moving the carriage in step (b), wherein if the pulse width is less than a predetermined width, the pulse width is reset and steps (b) and (c) are repeated, wherein if the pulse width is at least the predetermined width, step (d) is then executed;

(d) counting a number of the timing pulses after the pulse width measured in step (c) reaches at least a predefined reference time;

(e) stopping the drive mechanism when the number of timing pulses is equal to a predetermined value.

2. The printer control method of claim 1, further comprising the steps of:

(f) counting the timing pulses that are output from the position detection means while moving the carriage located from the reference position by driving the drive mechanism;

(g) printing one line according to recording data after the carriage reaches a print area; and (h) stopping the drive mechanism when no recording data remains to be printed and the timing pulse count reaches a predefined reference count.

3. The printer control method of claim 1, further comprising the steps of:

(f) counting the timing pulses that are output from the position detection means while moving the carriage located at the reference position by driving the drive mechanism;

(g) printing one line according to recording data after when the carriage reaches the print area;

(h) if more recording data remains to be printed, then measuring a time between adjacent timing pulses until the timing pulse count reaches a predefined reference count;

(i) resetting the pulse count and counting the timing pulses again when the time between adjacent pulses is at least a predefined reference time; and (j) printing another line after the carriage reaches the print area.

4. A printer comprising:

a carriage comprising a recording head mounted thereon;

a drive mechanism having a rotating shaft for reciprocating said carriage;

an encoder on which target-detection units are arranged contiguously at prescribed intervals in a circumferential direction and which is mounted on said shaft of said drive mechanism and which rotates as said carriage moves;

position detection means provided in proximity to said encoder for generating timing pulses by detecting said target-detection units on said encoder;

a shielding plate which is attached to said carriage and which intercepts a path between said encoder and said position detection means at a reference position of said carriage; and processing means for:

measuring a pulse width of the timing pulses from said position detection means while said carriage moves, wherein if the pulse width is less than a predetermined width, the pulse width is reset and said drive mechanism drives said carriage, wherein if the pulse width is at least the predetermined width, a number of the timing pulses is counted after the measured pulse width reaches at least a predefined reference time and said drive mechanism is stopped when the number of pulses is equal to a predetermined value.

5. A printer comprising:

a carriage comprising a recording head mounted thereon;

a drive mechanism for reciprocating said carriage;

a pulse generator having a rotary encoder operatively coupled to said drive mechanism and a fixed detector adapted to output timing pulses in response to a movement of said carriage;

position detection means for detecting a reference position of the carriage;

a shielding plate arranged to be engaged with and disengaged from the pulse generator while the carriage is in a predetermined position, to prevent the pulse generator from responding to a movement of the carriage; and processing means for:

measuring a pulse width of the timing pulses from said pulse generator, wherein if the pulse width is less than a predetermined width, the pulse width is reset and said drive mechanism drives said carriage, and wherein if the pulse width is at least the predetermined width a number of the timing pulses is counted after the measured pulse width reaches at least a predefined reference time and said drive mechanism is stopped when the number of pulses is equal to a predetermined value.

6. A printer comprising:

a carriage comprising a recording head mounted thereon;

a drive mechanism for reciprocating said carriage;

a pulse generator having a rotary encoder operatively coupled to said drive mechanism and a fixed detector adapted to output timing pulses in response to a movement of said carriage;

position detection means for detecting a reference position of the carriage;

a shielding plate which is attached to said carriage and which directly intercepts the path between the encoder and the detector at a predetermined position of the carriage, to prevent the pulse generator from responding to a movement of the carriage; and processing means for receiving the timing pulses from the detector and for detecting the predetermined position of the carriage based on the intervals between successive timing pulses.

* * * * *